US009366999B2

(12) United States Patent
Michishita

(10) Patent No.: US 9,366,999 B2
(45) Date of Patent: Jun. 14, 2016

(54) TRANSFERRING DEVICE AND IMAGE FORMING APPARATUS

(71) Applicant: KYOCERA Document Solutions Inc., Osaka (JP)

(72) Inventor: Yasuhiro Michishita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/748,052

(22) Filed: Jun. 23, 2015

(65) Prior Publication Data

US 2015/0378285 A1 Dec. 31, 2015

(30) Foreign Application Priority Data

Jun. 30, 2014 (JP) ..... 2014-133691

(51) Int. Cl.
*G03G 15/16* (2006.01)
*G03G 15/00* (2006.01)

(52) U.S. Cl.
CPC ..... *G03G 15/1665* (2013.01); *G03G 15/657* (2013.01)

(58) Field of Classification Search
CPC ..... G03G 15/1665–15/1685; G03G 15/6535; G03G 15/657
See application file for complete search history.

(56) References Cited

U.S. PATENT DOCUMENTS 4,338,017 A * 7/1982 Nishikawa ..... G03G 15/1675 399/145
4,396,273 A * 8/1983 Matsuyama ..... G03G 15/167 118/620
4,401,383 A * 8/1983 Suzuki ..... G03G 15/1675 399/145
4,415,254 A * 11/1983 Nishikawa ..... G03G 15/1635 399/171
5,198,864 A * 3/1993 Fletcher ..... G03G 15/1695 399/314
5,722,012 A * 2/1998 Saitoh ..... G03G 15/2064 399/400
6,097,924 A * 8/2000 Okuyama ..... G03G 15/167 399/101
2007/0041756 A1* 2/2007 Akaike ..... G03G 15/167 399/310
2012/0002996 A1* 1/2012 Izumi ..... G03G 15/161 399/88

FOREIGN PATENT DOCUMENTS

JP 2002-031960 A 1/2002

* cited by examiner

*Primary Examiner* — David Gray
*Assistant Examiner* — Carla Therrien
(74) *Attorney, Agent, or Firm* — Studebaker & Brackett PC

(57) ABSTRACT

A transferring device includes a conveying belt, a transferring roller, a stretching roller and a guide member. The conveying belt comes into contact with an image carrier carrying a toner image and conveys a sheet via a contact position to the image carrier. The transferring roller takes applying of voltage with a reversed polarity to a charged polarity of the toner forming the toner image and transfers the toner image carried on the image carrier onto the sheet at the contact position. The stretching roller stretches the conveying belt at a downstream side from the contact position in a conveying direction of the conveying belt and at a separation position of the sheet separated from the conveying belt. The guide member is arranged at a position facing to the sheet conveyed from the stretching roller to a fixing device to take applying of the voltage with the reversed polarity.

15 Claims, 9 Drawing Sheets

FIG. 6

| | STRUCTURE OF TRANSFERRING DEVICE 35 | | SOILED DEGREE OF CATCHING MEMBER 36A | OCCURRENCE OF IMAGE FAILURE |
|---|---|---|---|---|
| | SECOND ROLLER 354 | GUIDE MEMBER 355 | | |
| EXAMPLE 1 | ALUMINUM, CONNECTION TO VOLTAGE APPLYING PART 356A | CONDUCTIVE MATERIAL, CONNECTION TO VOLTAGE APPLYING PART 356A | ◎ | NO |
| EXAMPLE 2 | ALUMINUM, CONNECTION TO VOLTAGE APPLYING PART 356B | CONDUCTIVE MATERIAL, CONNECTION TO VOLTAGE APPLYING PART 356B | ◎ | NO |
| COMPARATIVE EXAMPLE 1 | ALUMINUM, GROUNDING BY BEARING | SURFACE RESISTIVITY 1000Ω/cm$^2$, CONNECTION TO RESISTOR OF 100MΩ | × | YES |
| COMPARATIVE EXAMPLE 2 | ALUMINUM, CONNECTION TO VOLTAGE APPLYING PART 356A | SURFACE RESISTIVITY 1000Ω/cm$^2$, CONNECTION TO RESISTOR OF 100MΩ | ◎ | YES |

FIG. 9

| | STRUCTURE OF TRANSFERRING DEVICE 35 | | SOILED DEGREE OF CATCHING MEMBER 36A | OCCURRENCE OF IMAGE FAILURE |
|---|---|---|---|---|
| | SECOND ROLLER 354 | GUIDE MEMBER 355 | | |
| EXAMPLE 3 | POLYACETAL | CONDUCTIVE MATERIAL, CONNECTION TO VOLTAGE APPLYING PART 356A | ◎ | NO |
| EXAMPLE 4 | POLYACETAL | CONDUCTIVE MATERIAL, CONNECTION TO VOLTAGE APPLYING PART 356B | ◎ | NO |
| COMPARATIVE EXAMPLE 3 | ALUMINUM, GROUNDING BY BEARING | SURFACE RESISTIVITY 1000Ω/cm$^2$, CONNECTION TO RESISTOR OF 100MΩ | × | YES |
| COMPARATIVE EXAMPLE 4 | POLYACETAL | SURFACE RESISTIVITY 1000Ω/cm$^2$, CONNECTION TO RESISTOR OF 100MΩ | ◎ | YES |

TRANSFERRING DEVICE AND IMAGE FORMING APPARATUS

INCORPORATION BY REFERENCE

This application is based on and claims the benefit of priority from Japanese Patent application No. 2014-133691 filed on Jun. 30, 2014, the entire contents of which are incorporated herein by reference.

BACKGROUND

The present disclosure relates to an image forming apparatus forming an image in an electrographic manner and a transferring device provided in the image forming apparatus.

Generally, in an image forming apparatus, such as a printer, capable to form an image in an electrographic manner, it is known as a configuration that a toner image formed on an image carrier, such as a photosensitive drum, is transferred onto a sheet, such as a printing paper, conveyed in a state electrostatically attracted onto a conveying belt. In this kind of the image forming apparatus, by electrostatically attracting the sheet onto the conveying belt, improvement of separation property from the image carrier, conveyance stability and transferring performance of the sheet is actualized.

However, in a case where the sheet is conveyed in the state electrostatically attracted onto the conveying belt, if a roller arranged at a separation position where the sheet is separated from the conveying belt is grounded, separation electric discharge may occur when the sheet is separated from the conveying belt and electrostatic adhesion of a toner to the sheet may be weakened. In such a case, until the sheet is conveyed to a fixing device, it is feared that the toner adhered onto the sheet is scattered. In addition, it is feared that the toner on the sheet is not fixed in the fixing device and is electrostatically adhered onto a fixing member, such as a fixing roller, and then, a phenomenon so-called as electrostatic offset causing image failure in the following sheet occurs.

SUMMARY

In accordance with one aspect of the present disclosure, a transferring device includes a conveying belt, a transferring roller, a stretching roller and a guide member. The conveying belt comes into contact with an image carrier carrying a toner image and conveys a sheet via a contact position to the image carrier. The transferring roller takes applying of voltage with a reversed polarity to a charged polarity of the toner forming the toner image and transfers the toner image carried on the image carrier onto the sheet at the contact position. The stretching roller stretches the conveying belt at a downstream side from the contact position in a conveying direction of the conveying belt and at a separation position, where the sheet is separated from the conveying belt. The guide member is arranged at a position facing to the sheet conveyed from the stretching roller to the fixing device fixing the toner image onto the sheet to take applying of the voltage with the reversed polarity to the charged polarity of the toner.

In accordance with another aspect of the present disclosure, an image forming apparatus includes the above-mentioned transferring device.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 6 is a table showing experiment results of the image forming apparatus according to the first embodiment of the present disclosure.

FIG. 9 is a table showing experiment results of the image forming apparatus according to the second embodiment of the present disclosure.

DETAILED DESCRIPTION

In the following, with reference to the accompanying drawings, embodiments of the present disclosure will be described in order to understand the present disclosure. The following embodiments are examples concreated the present disclosure, but do not limit the technical range of the present disclosure.

Firstly, with reference to FIGS. 1 and 2, schematic structure of an image forming apparatus 10 of the embodiment of the present disclosure will be described. Here, FIG. 1 is a schematic sectional view showing structure of the image forming apparatus 10.

Figure 1:
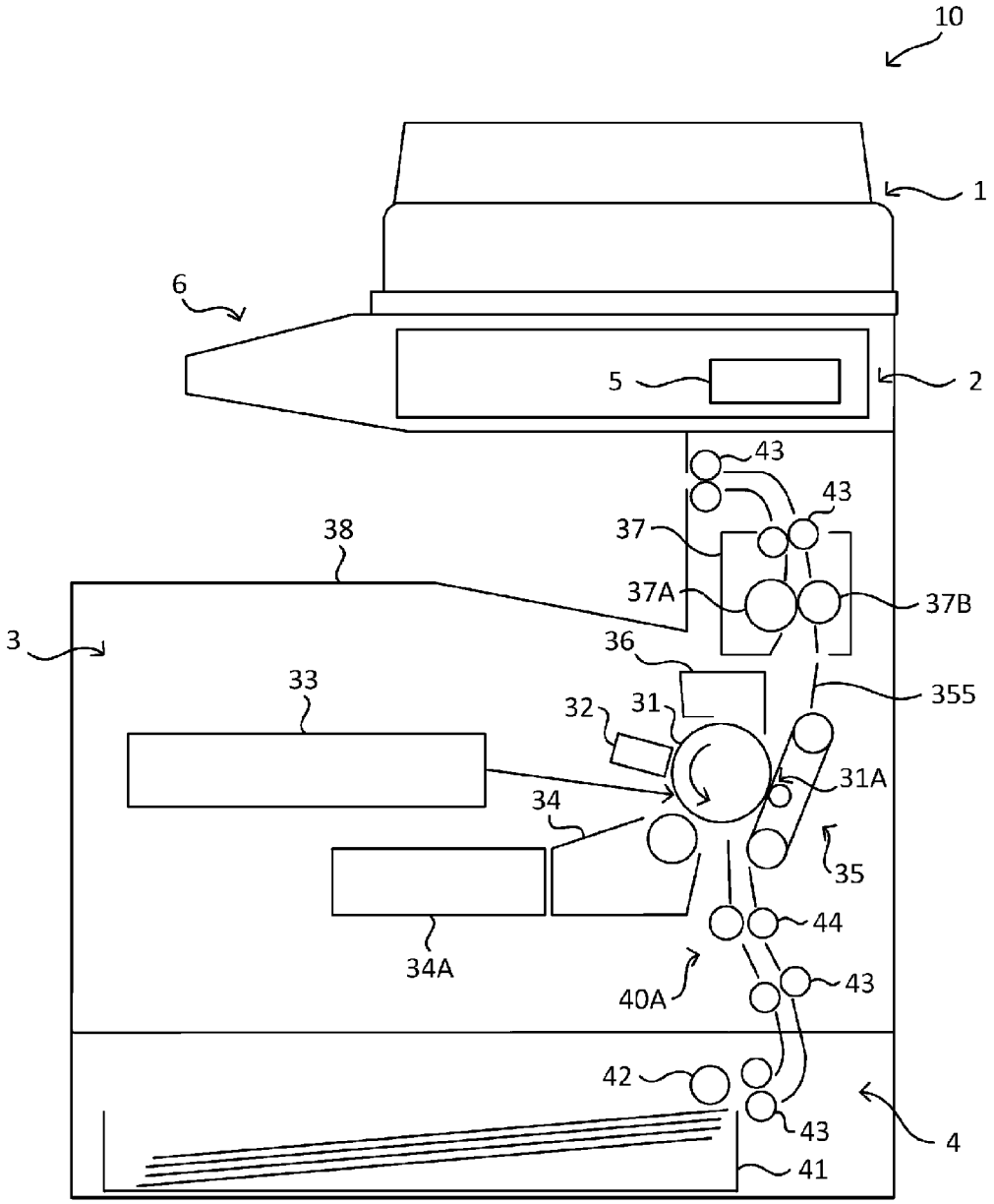
FIG. 1 is a sectional view schematically showing structure of an image forming apparatus according to a first embodiment of the present disclosure.
Figure 2:
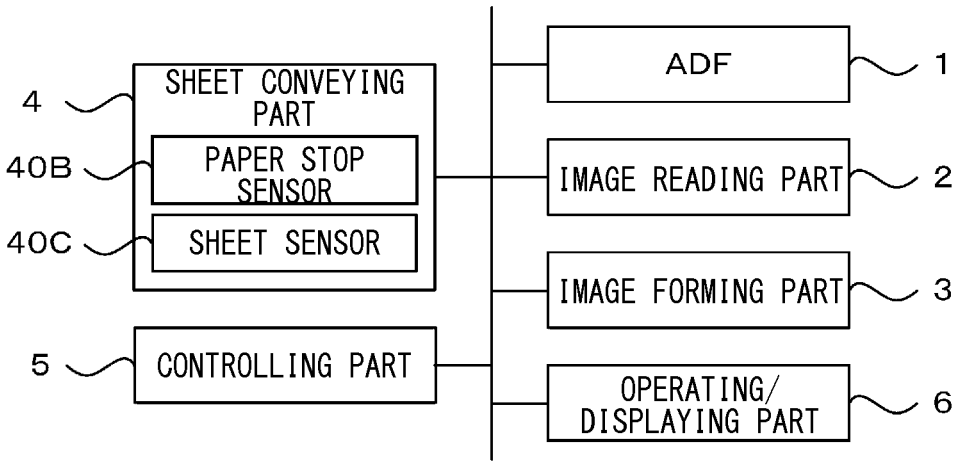
FIG. 2 is a block diagram showing system configuration of the image forming apparatus according to the first embodiment of the present disclosure.

As shown in FIGS. 1 and 2, the image forming apparatus 10 includes an ADF (Automatic Document Feeder) 1, an image reading part 2, an image forming part 3, a sheet conveying part 4, a controlling part 5 and an operating/displaying part 6. The image forming apparatus 10 is a multifunction peripheral having a printer function forming an image on the basis of image data and having a plurality of functions, such as a scanning function, a facsimile function and a copying function. Alternatively, the present disclosure may be applied to another image forming device, such as printer device, a facsimile device or a copying machine.

The ADF 1 includes a document placed part, a plurality of conveying rollers, a document holding-down part and a sheet ejecting part (respectively, not shown) to be as an automatic document feeder conveying a document read by the image reading part 2. The image reading part 2 includes a document platen, a reading unit, a plurality of mirrors, an optical lens and a CCD (Charge Coupled Device) (respectively, not shown) to read the image data from the document. The controlling part 5 includes control equipment (not shown), such as CPU (Central Processing Unit), a ROM (Read Only Memory), a RAM (Random Access Memory) and an EEPROM (Electrically Erasable Programmable Read Only Memory), to control operation of the image forming apparatus 10. The operating/displaying part 6 includes a displaying part, such as a liquid crystal display, displaying various information in accordance with control instruction from the controlling part 5 and an operating part, such as operation keys or a touch panel, inputting various information into the controlling part 5 in accordance with operation of a user.

The image forming part 3 can execute image forming process (printing process) forming the image on the basis of the image data read by the image reading part 2 in an electrographic manner. The image forming part 3 also can execute the image forming process on the basis of the image data inputted from an information processing device, such as an external personal computer.

Concretely, the image forming part 3 includes, as shown in FIG. 1, a photosensitive drum 31, a charging device 32, an optical scanning device (LSU: Laser Scanning Unit) 33, a developing device 34, a transferring device 35, a cleaning device 36, a fixing device 37 and an ejected sheet tray 38. In the image forming part 3, the image is formed onto the sheet fed from the sheet conveying part 4 by the following procedure and the sheet after image forming is ejected to the ejected sheet tray 38. Incidentally, the sheet is a sheet material, such as a paper, a coated paper, a post card, an envelope, an OHP (OverHead Projector) sheet.

Firstly, the photosensitive drum 31 is electrically charged evenly at predetermined electrical potential by the charging device 32. Subsequently, a surface of the photosensitive drum 31 is irradiated with a light based on the image data by the optical scanning device 33. Thereby, an electrostatic latent image corresponding to the image data is formed onto the surface of the photosensitive drum 31. Moreover, the electrostatic latent image on the photosensitive drum 31 is developed (visualized) as a toner image by the developing device 34. Here, the photosensitive drum 31 is one example of an image carrier in the present disclosure. Incidentally, in the developing device 34, a toner (a developer) is replenished from a toner container 34A attachable to/detachable from the image forming part 3. In the image forming apparatus 10, the toner is agitated together with a carrier inside the developing device 34, thereby being triboelectrically charged, for example, at positive polarity.

Subsequently, the toner image formed onto the photosensitive drum 31 is transferred onto the sheet by the transferring device 35. Concretely, the toner image is transferred onto the sheet at a contact position 31A of the photosensitive drum 31 with a conveying belt 351 (refer to FIG. 3) of the transferring device 35. Incidentally, the transferring device 35 will be described later in detail. After that, when the sheet passes through between a fixing roller 37A and a pressuring roller 37B of the fixing device 37, the toner image transferred onto the sheet is heated and molten and fixed by the fixing roller 37A. Incidentally, the toner remained on the surface of the photosensitive drum 31 is removed by the cleaning device 36.

The sheet conveying part 4 conveys the sheet onto which the image is formed by the image forming part 3. Concretely, the sheet conveying part 4 includes, as shown in FIG. 1, a sheet feeding cartridge 41, a pickup roller 42, a plurality of pairs of conveying rollers 43 and a pair of paper stop rollers 44. The pickup roller 42, the plurality of pairs of conveying rollers 43 and the pair of paper stop rollers 44 are rotated by driving power produced and transmitted by a motor (not shown) to convey the sheet.

The sheet feeding cartridge 41 is attachable to/detachable from a housing of the image forming apparatus 10 to store the sheet onto which the image is formed by the image forming part 3. The sheet stored in the sheet feeding cartridge 41 is lifted up to a contact position with the pickup roller 42 arranged in an upper part of the sheet feeding cartridge 41 by a lift plate (not shown) arranged in a bottom part of the sheet feeding cartridge 41. An uppermost sheet coming into contact with the pickup roller 42 is sent out to a conveying path 40A by the pickup roller 42 and is conveyed in the conveying path 40A by the pairs of the conveying rollers 43.

The pair of paper stop rollers 44 send out the sheet to the contact position 31A at a predetermined timing synchronized with arrival of the toner image transferred on the photosensitive drum 31 at the contact position 31A. Concretely, at an upstream side from the pair of paper stop rollers 44 in a conveying direction of the sheet in the conveying path 40A, a paper stop sensor 40B (refer to FIG. 2) detecting existence of the sheet is arranged. The paper stop sensor 40B is, for example, an optical sensor in a transmissive type or a reflective type. The controlling part 5 determines the timing on the basis of a distance from a detection position of the sheet to the contact position 31A, conveying speed of the sheet and others, when an electrical signal indicating detection of the sheet is outputted from the paper stop sensor 40B. The controlling part 5 controls an electromagnetic clutch (not shown) switchable ON/OFF of transmission of the driving power from the motor to the pair of paper stop rollers 44, thereby rotating the pair of paper stop rollers 44 at the timing and sending out the sheet. Thereby, in synchronization with the arrival of the toner image transferred on the photosensitive drum 31 at the contact position 31A, the sheet is sent out to the contact position 31A.

Subsequently, the sheet passed through the contact position 31A and taking transferring of the toner image passes through between the fixing roller 37A and the pressuring roller 37B of the fixing device 37, and then, the toner image is molten and fixed, and moreover, the sheet is conveyed to the ejected sheet tray 38 by the pairs of the conveying rollers 43 and ejected.

Here, in the image forming apparatus 10, occurrence of a jam (a paper jam) in the conveying path 40A is detected. Concretely, in the conveying path 40A, a plurality of sheet sensors 40C (refer to FIG. 2) detecting existence of the sheet are arranged together with the paper stop sensor 40B. The controlling part 5 detects the occurrence of the jam, for example, in a case where a signal indicating detection of the sheet is not outputted from the paper stop sensor 40B or the sheet sensors 40C until a predetermined time is elapsed after conveyance of the sheet is started. The sheet sensor 40C is, for example, an optical sensor in a transmissive type or a reflective type.

Incidentally, in the image forming apparatus 10, the sheet is conveyed in a state electrostatically attracted onto the conveying belt 351. Thereby, improvement of separation property from the photosensitive drum 31 of the sheet, conveyance stability of the sheet and transferring performance of the toner image onto the sheet is actualized.

However, in a case where the sheet is conveyed in the state electrostatically attracted onto the conveying belt 351, if a roller arranged at a separation position where the sheet is separated from the conveying belt 351 is grounded, separation electric discharge may occur when the sheet is separated from the conveying belt 351 and electrostatic adhesion of the toner to the sheet may be weakened. In such a case, until the sheet is conveyed to the fixing device 37, the toner adhered onto the sheet may be scattered. In addition, the toner on the sheet may not be fixed in the fixing device 37 and may be electrostatically adhered onto the fixing roller 37A, and then, a phenomenon so-called as electrostatic offset causing image failure in the following sheet occurs. By contrast, in the image forming apparatus 10, as described later, it is possible to improve the electrostatic adhesion of the toner to the sheet.

Figure 3:
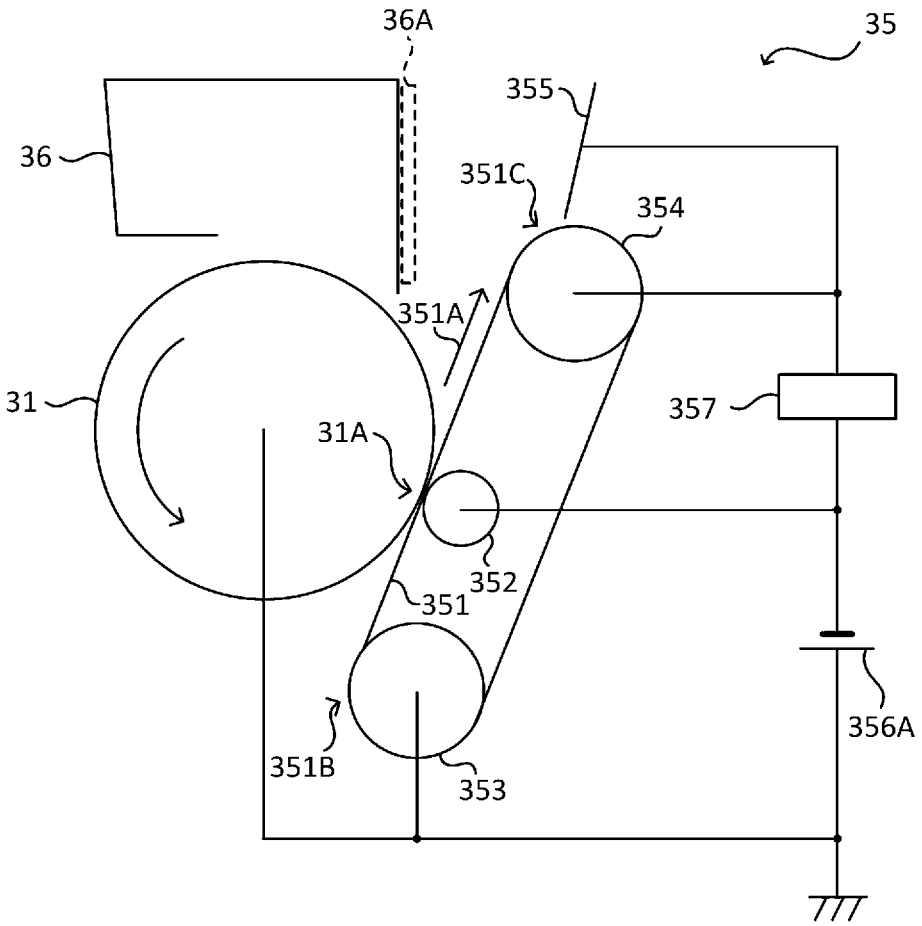
FIG. 3 is a sectional view schematically showing one example of structure of a transferring device of the image forming apparatus according to the first embodiment of the present disclosure.
Figure 4:
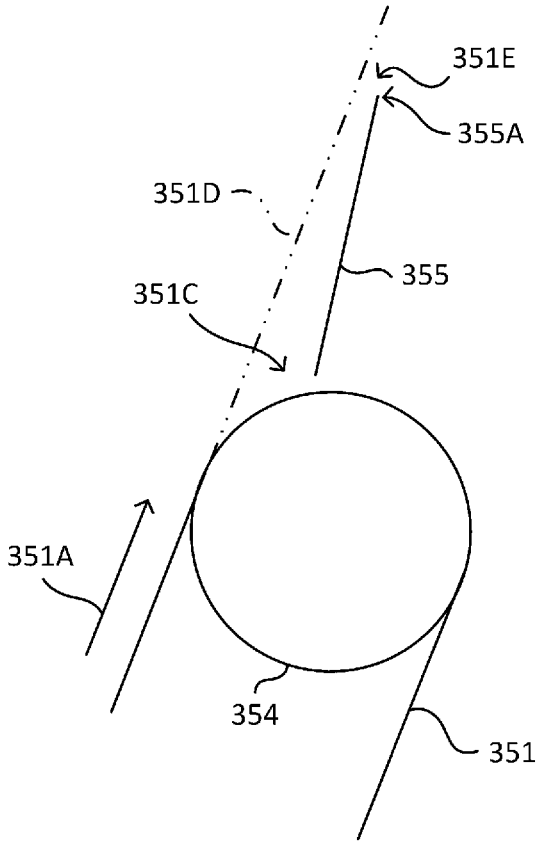
FIG. 4 is a sectional view schematically showing structure of the periphery at a separation position in the image forming apparatus according to the first embodiment of the present disclosure.
Figure 5:
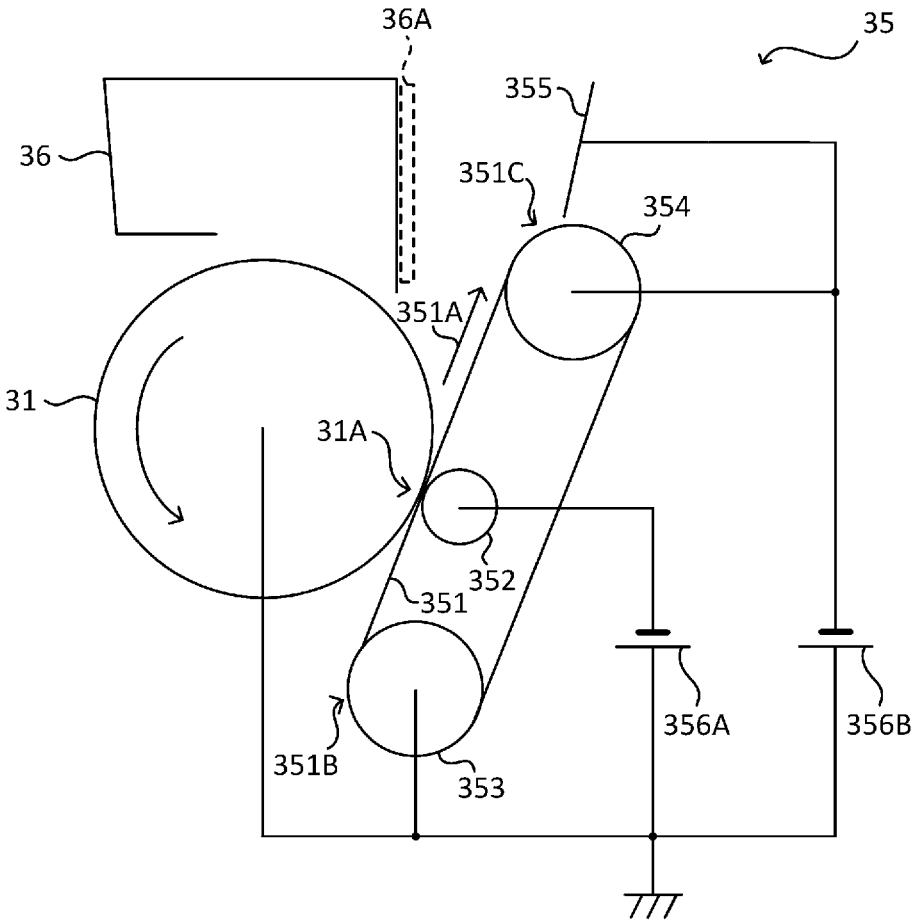
FIG. 5 is a sectional view schematically showing another example of structure of the transferring device of the image forming apparatus according to the first embodiment of the present disclosure.

In the following, with reference to FIGS. 3-5, the transferring device 35 of a first embodiment will be described. Here, FIGS. 3 and 5 are schematic sectional views showing structure examples of the transferring device 35. FIG. 4 is a schematic sectional view showing structure of the periphery at a separation position 351C in the image forming apparatus 10. A two-dot chain line in FIG. 4 indicates a moving path 351D of the sheet separated from the conveying belt 351.

The transferring device 35 conveys the sheet with electrostatically attracting the sheet sent out from the pair of paper stop rollers 44 onto the conveying belt 351 and transfers the toner image formed on the photosensitive drum 31 at the contact position 31A onto the sheet. Concretely, the transferring device 35 includes, as shown in FIG. 3, the conveying belt 351, a transferring roller 352, a first roller 353, a second roller 354, a guide member 355, a voltage applying part 356A and a resistor 357.

The conveying belt 351 comes into contact with the photosensitive drum 31 and conveys the sheet through the contact position 31A. Concretely, the conveying belt 351 is, as shown in FIG. 3, an endless belt member stretched by predetermined tension by the first roller 353 and the second roller 354. For example, the conveying belt 351 is made by coating an external circumference face of a belt like member made of rubber by fluorine resin. An external circumference face of the conveying belt 351 is moved along a conveying direction 351A by driving and rotating the first roller 353 or the second roller 354 by the motor (not shown). Thereby, the conveying belt 351 can convey the sheet from a conveyance starting position 31B to the separation position 351C through the contact position 31A.

The transferring roller 352 takes applying of voltage with a reversed polarity to a charged polarity of the toner forming the toner image and transfers the toner image carried on the photosensitive drum 31 onto the sheet at the contact position 31A. Concretely, the transferring roller 352 is arranged, as shown in FIG. 3, so as to come into contact with an internal circumference face of the conveying belt 351 at the contact position 31A. The transferring roller 352 produces electric discharge between the transferring roller 352 and the conveying belt 351 at the contact position 31A by taking applying of voltage with a negative polarity from the voltage applying part 356A and injects an electric charge with the negative polarity to the conveying belt 351. Thereby, the toner image formed on the photosensitive drum 31 is attracted to the conveying belt 351 and transferred onto the sheet. Moreover, by the electric charge injected to the conveying belt 351, the sheet conveyed by the conveying belt 351 is electrostatically attracted onto the conveying belt 351.

The first roller 353 stretches the conveying belt 351 at an upstream side from the contact position 31A in the conveying direction 351A of the conveying belt 351 and at the conveyance starting position 351B, where conveyance of the sheet is started. For example, the first roller 353 is made of electric conductive material, such as metal, and is arranged in the transferring device 35 in a state grounded via a bearing. Therefore, a part of the electric charge injected to the conveying belt 351 is eliminated by the first roller 353.

The second roller 354 stretches the conveying belt 351 and at a downstream side from the contact position 31A in the conveying direction 351A of the conveying belt 351 and at the separation position 351C, where the sheet is separated from the conveying belt 351. Here, the second roller 354 is one example of stretching roller in the present disclosure.

The guide member 355 guides the sheet separated from the conveying belt 351 at the separation position 351C to the fixing device 37. Concretely, the guide member 355 is arranged, as shown in FIG. 4, at a position facing to the sheet conveyed from the second roller 354 to the fixing device 37 along the moving path 351D. Thereby, a leading end part of the sheet in the conveying direction 351A is hung downwardly in a perpendicular direction by empty weight and the sheet is restrained from coming off the moving path 351D and moving. In the image forming apparatus 10, the guide member 355 is placed in a predetermined posture with respect to the moving path 351D, and thereby, separation action of the sheet separating from the conveying belt 351 by curvature separation is supported. For example, the guide member 355 is placed so that an angle made of a straight line extending from an axial center of the second roller 354 to a contact point with the second roller 354 in the moving path 351D and a straight line extending from the axial center of the second roller 354 to a trailing end part of the guide member 355 in the conveying direction 351A is defined within a range from 30 degrees or more to 60 degrees or less.

Here, in a case where the second roller 354 is grounded, when the sheet electrostatically attracted onto the external circumference face of the conveying belt 351 is separated from the conveying belt 351 at the separation position 351C, separation electric discharge is produced between the sheet and the conveying belt 351. Concretely, on the basis of position relationship of respective materials of the sheet and the conveying belt 351 in a triboelectric series, replacement of an electric charge is carried out between the sheet and the conveying belt 351. For example, in a case where the material of the sheet is a paper and the external circumference face of the conveying belt 351 is made of fluorine resin, such as PTFE (polytetrafluoroethylene), the sheet discharges the electric charge with the negative polarity and is electrically charged to a positive polarity when separating from the conveying belt 351 and the conveying belt 351 receives the electric charge discharged from the sheet and is electrically charged to the negative polarity. In such a case, electrostatic adhesion of the toner with the positive polarity adhered onto the sheet with respect to the sheet may be weakened and the toner may be scattered from the sheet. Moreover, the electrostatic offset may be in the fixing device 37 and image failure may occur.

By contrast, in the image forming apparatus 10, the voltage with the reversed polarity to the charged polarity of the toner is applied to the guide member 355. Concretely, the guide member 355 is made of electric conductive material and takes applying of the voltage with the negative polarity from the voltage applying part 356A. Thereby, it is possible to produce electric discharge between the sheet conveyed from the second roller 354 to the fixing device 37 along the moving path 351D and the guide member 355 and inject the electric charge with the negative polarity to the sheet. Therefore, it is possible to improve electrostatic adhesion of the toner with respect to the sheet.

More concretely, the guide member 355 is arranged, as shown in FIG. 4, at a gap 351E with a predetermined width between a leading end part 355A of the guide member 355 and the sheet conveyed along the moving path 351D. Here the width of the gap 351E is suitable determined on the basis of a Paschen's law so as to produce the electric discharge between the leading end part 355A of the guide member 355 and the sheet. For example, in the image forming apparatus 10, the gap 351E is determined by 1 mm.

The guide member 355 is arranged at a position facing to a face of the sheet at a side of the second roller 354. Therefore, as compared with configuration that the guide member 355 is arranged at another position facing to another face of the sheet where the toner image is formed, the electric discharge between the guide member 355 and the sheet is restrained from affecting on the toner image formed on the sheet.

Further, in the image forming apparatus 10, the voltage with the reversed polarity to the charged polarity of the toner is applied to the second roller 354. Concretely, the second roller 354 takes applying of the voltage with the negative polarity from the voltage applying part 356A. Thereby, moving of the electric charge with the negative polarity from the sheet to the conveying belt 351, i.e. occurrence of separation electric discharge is restrained. Incidentally, as another embodiment, a configuration without applying the voltage to the second roller 354 may be considered.

The voltage applying part 356A applies the voltage with the reversed polarity to the charged polarity of the toner to the transferring roller 352, the second roller 354 and the guide member 355. Here, the voltage applying part 356A applying the voltage to the transferring roller 352, the second roller 354 and the guide member 355 is one example of a first voltage applying part in the present disclosure.

Concretely, the voltage applying part 356A is, as shown in FIG. 3, a power source connected to the voltage to the transferring roller 352, the second roller 354 and the guide member 355. The voltage applying part 356A is controlled by the controlling part 5 to apply the voltage with the negative polarity to the transferring roller 352, the second roller 354 and the guide member 355. For example, the controlling part 5 controls the voltage applying part 356A so that electric current of −100 μA in all is flowed to the transferring roller 352, the second roller 354 and the guide member 355. Thereby, the present disclosure can be actualized without separately providing another power source applying the voltage to the guide member 355.

Incidentally, if the voltage applying part 356A applies the voltage only during the sheet passes through the contact position 31A, the voltage may not be applied to the guide member 355 while a trailing end part of the sheet in the conveying direction 351A is moved from the contact position 31A to the leading end part 351A of the guide member 355. In such a case, the electric discharge between a part of the sheet and the guide member 355 is not produced. Thereupon, in the image forming apparatus 10, the voltage applying part 356A applies the voltage to the transferring roller 352, the second roller 354 and the guide member 355 until the trailing end part of the sheet in the conveying direction 351A is separated from the leading end part 355A of the guide member 355 after the leading end part of the sheet in the conveying direction 351A arrives at the contact position 31A.

Concretely, the controlling part 5 acquires an arrival timing of the leading end part of the sheet at the contact position 31A and a separation timing of the trailing end part of the sheet from the leading end part 355A on the basis of the electrical signal indicating the detection of the leading end part of the sheet and the electrical signal indicating the detection of the trailing end part of the sheet outputted from the paper stop sensor 40B. Moreover, the controlling part 5 makes the voltage applying part 356A apply the voltage on the basis of the arrival timing and the separation timing in a period from the arrival of the leading end part of the sheet at the contact position 31A to the separation of the trailing end part of the sheet from the leading end part 355A. Thereby, it is possible to produce the electrical discharge between the entire sheet and the guide member 355.

When the voltage applying part 356A applies the voltage to the transferring roller 352, the second roller 354 and the guide member 355, excessive current may be flowed from the second roller 354 or the guide member 355 to the fixing device 37 via the sheet. In such a case, current quantity flowing from the transferring roller 352 to the photosensitive drum 31 may become insufficient and density of the toner image transferred onto the sheet may be deteriorated. Particularly, in a case where water content of the sheet is high, the excessive current is easily flowed from the second roller 354 or the guide member 355 to the fixing device 37 via the sheet. Thereupon, in the image forming apparatus 10, as shown in FIG. 3, the second roller 354 and the guide member 355 are connected to the voltage applying part 356A via a common electric conductive path and the resistor 357 is arranged on the common electric conductive path. Here, the resistor 357 arranged on the common electric conductive path is one example of a first resistor in the present disclosure.

Concretely, the resistor 357 has a resistance value higher than an electric conductive path including the transferring roller 352, the conveying belt 351 and the photosensitive drum 31. For example, the resistance value of the resistor 357 is 100 MΩ. Thereby, it is possible to restrain the excessive current from flowing from the second roller 354 or the guide member 355 to the fixing device 37 via the sheet.

Incidentally, in the image forming apparatus 10, in addition to the voltage applying part 356A applying the voltage to the transferring roller 352, another power source applying voltage to the second roller 354 and the guide member 355 may be provided. Concretely, in considerable configuration, the transferring device 35 includes, as shown in FIG. 5, the voltage applying part 356A applying the voltage with the reversed polarity to the charged polarity of the toner to the transferring roller 352 and another voltage applying part 356B applying the voltage with the reversed polarity to the charged polarity of the toner to the second roller 354 and the guide member 355. Here, the voltage applying part 356A applying the voltage to the transferring roller 352 is one example of a second voltage applying part in the present disclosure. The voltage applying part 356B applying the voltage to the second roller 354 and the guide member 355 is one example of a third voltage applying part in the disclosure.

For example, the controlling part 5 controls the voltage applying part 356A so as to flow the current of −100 μA to the transferring roller 352 and controls the voltage applying part 356B so as to flow the current of −15 μA in all to the second roller 354 and the guide member 355. Thus, in a case where the voltage applying part 356B applying the voltage to the second roller 354 and the guide member 355 is provided in addition to the voltage applying part 356A applying the voltage to the transferring roller 352, it is possible to separate controlling of the voltage applied to the second roller 354 and the guide member 355 from controlling of the voltage applied to the transferring roller 352.

In the image forming apparatus 10, experimentation searching scattering condition of the toner at the separation position 351C and occurrence condition of the image failure was carried out while varying structure of the transferring device 35 as Example 1 and Example 2. Experiment results are shown in FIG. 6. Incidentally, the search of the scattering condition of the toner in the experimentation was carried out in a way arranging a catching member 36A (refer to FIG. 3) onto an outside face of the cleaning device 36 facing to the separation position 351C and confirming soiled degree of the catching member 36A after the printing process printing experimental image data at a printing rate of 50 percent in the image forming apparatus 10 is executed ten thousand times.

The search of the occurrence condition of the image failure in the experimentation was carried out in a way confirming whether or not the image failure occurs during the printing process of ten thousand times. Here, in FIG. 6, a double circle indicates that soiling due to the toner is not confirmed in the catching member 36A. A cross mark indicates that soiling due to the toner confirmed in the catching member 36A exceeds a predetermined permissible range.

In accordance with the experiment results shown in FIG. 6, in a case where the voltage is applied to the guide member 355 (in Example 1 and Example 2), as compared with a case where the voltage is not applied to the guide member 355, the occurrence of the image failure is restrained. This seems to be brought as a result of injecting the electric charge with the negative polarity to the sheet by the electric discharge produced between the guide member 355 and the sheet and improving the electrostatic adhesion of the toner with respect to the sheet.

Moreover, in accordance with the experiment results shown in FIG. 6, in a case where the voltage is applied to the second roller 354 (in Example 1, Example 2 and Comparative example 2), as compared with a case where the second roller 354 is grounded (in Comparative example 1), the scattering of the toner at the separation position 351C is restrained. This seems to be brought as a result of restraining the occurrence of the separation electric discharge between the sheet and the conveying belt 351 at the separation position 351C.

Thus, in the image forming apparatus 10, since the voltage with the reversed polarity to the charged polarity of the toner is applied to the guide member 355, the electric discharge occurs between the sheet and the guide member 355 and the electric charge with the reversed polarity to the charged polarity of the toner is injected to the sheet. Thereby, it is possible to improve the electrostatic adhesion of the toner with respect to the sheet.

Figure 7:
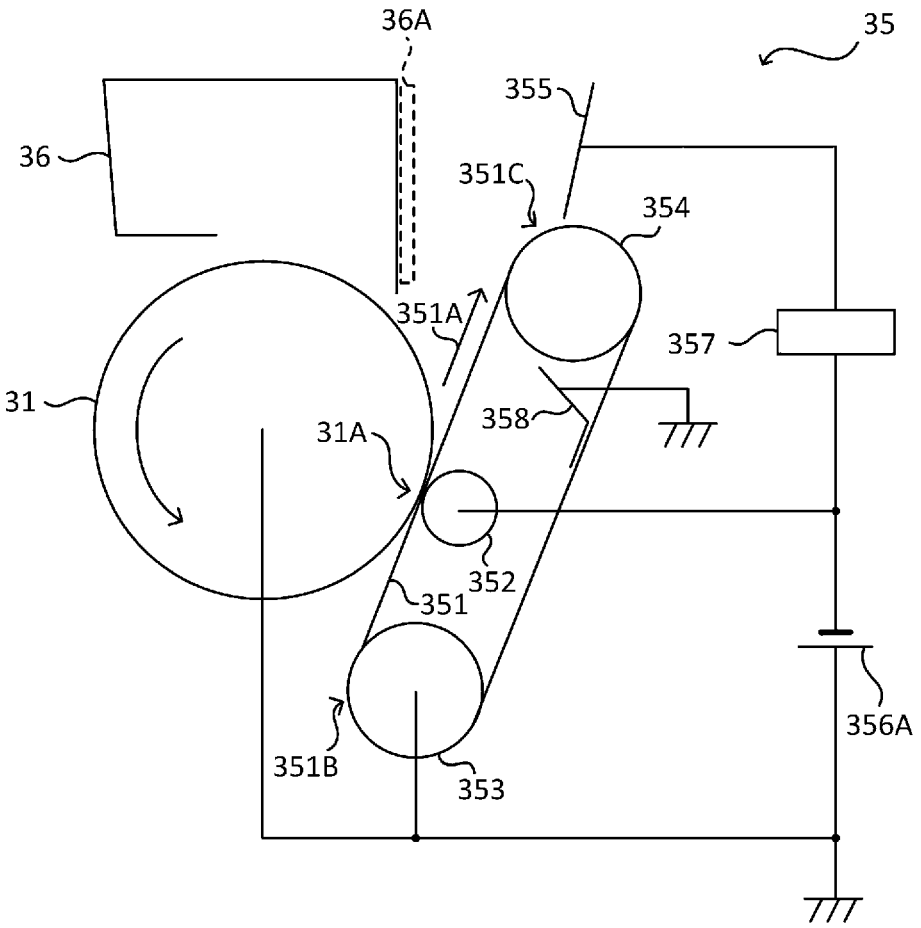
FIG. 7 is a sectional view schematically showing one example of structure of the transferring device of the image forming apparatus according to a second embodiment of the present disclosure.
Figure 8:
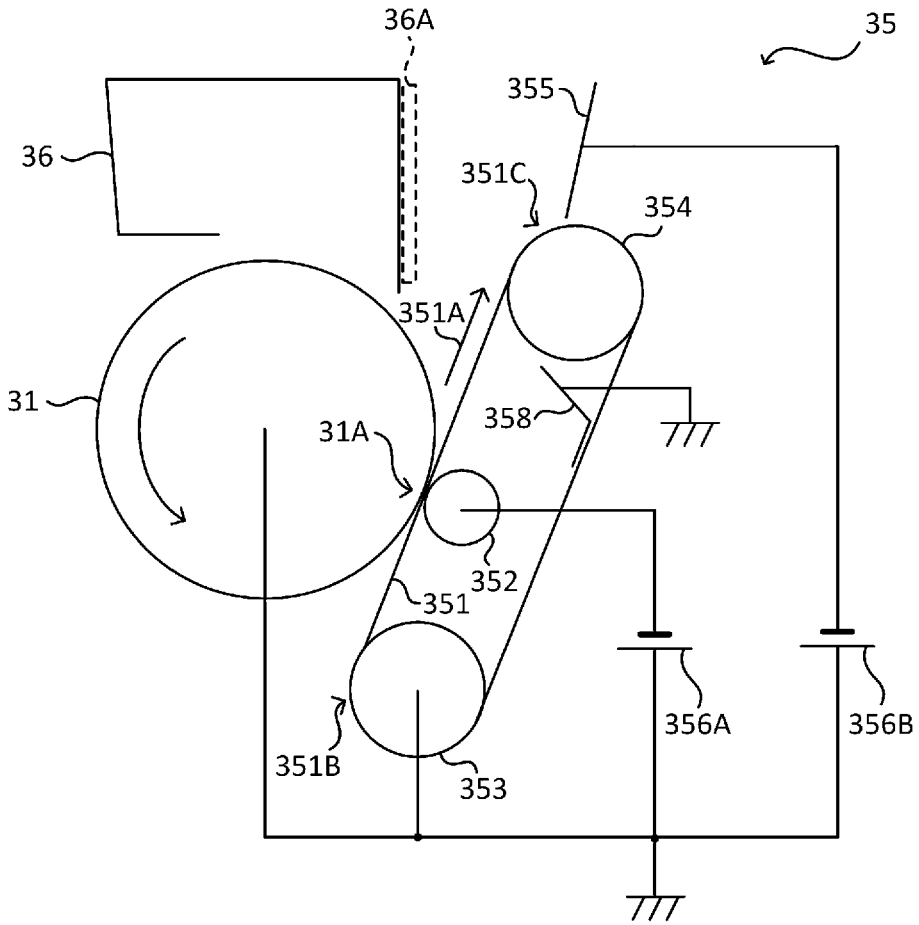
FIG. 8 is a sectional view schematically showing another example of structure of the transferring device of the image forming apparatus according to the second embodiment of the present disclosure.

In the following, with reference to FIGS. 7 and 8, an image forming apparatus 10 according to a second embodiment of the present disclosure will be described. Here, FIGS. 7 and 8 are schematic sectional views showing structure examples of the transferring device 35 and its periphery of the image forming apparatus 10 according to the second embodiment. Incidentally, with respect to common structures of the image forming apparatus 10 in accordance with the second embodiment to the image forming apparatus 10 in accordance with the first embodiment, description will be omitted.

The image forming apparatus 10 according to the second embodiment is different from the image forming apparatus 10 according to the first embodiment in structure of the second roller 354. Moreover, the image forming apparatus 10 according to the second embodiment includes, as shown in FIGS. 7 and 8, a static eliminating member 358, but does not connect the second roller 354 to any power source. Here, the voltage applying part 356A connected to the transferring roller 352 and the guide member 355 as shown in FIG. 7 is one example of a fourth voltage applying part in the present disclosure. The resistor 357 arranged on the electric conductive path between the voltage applying part 356A and the guide member 355 as shown in FIG. 7 is one example of a second resistor in the disclosure. The voltage applying part 356A connected to the transferring roller 352 as shown in FIG. 8 is one example of a fifth voltage applying part in the disclosure. The voltage applying part 356B connected to the guide member 355 as shown in FIG. 8 is one example of a sixth voltage applying part in the disclosure.

Concretely, in the image forming apparatus 10 according to the second embodiment, the second roller 354 is made of an insulator, such as synthetic resins, to become an insulation state, but is not grounded. Thereby, it is possible to maintain a charging state to the negative polarity of the conveying belt at the separation position 351C and to restrain the electric charge with the negative polarity from moving from the sheet to the conveying belt 351, i.e. to restrain separation electric discharge from occurring.

Incidentally, a way of making the second roller 354 to the insulation state is not restricted by the above-mentioned way. For example, a contact part to a rotation shaft of the second roller 354 may be formed by a bearing made of the insulator to support the second roller 354, thereby making the second roller 354 to the insulation state. In such a case, it is possible to actualize the present disclosure by using an existing roller member and it is unnecessary to separately provide new roller member made of the insulator. Alternatively, a surface layer of the second roller 354 may be made of the insulator, such as fluorine resin, thereby making the second roller 354 to the insulation state. In such a case, it is possible to actualize the present disclosure by coating the existing roller member.

The static eliminating member 358 is arranged, as shown in FIGS. 7 and 8, at a gap with a predetermined width between the static eliminating member 358 and the second roller 354 to eliminate a static charge on the second roller 354. For example, the static eliminating member 358 is a grounded electric conductive felt member. Concretely, the static eliminating member 358 eliminates the static charge on the second roller 354 by the electric discharge produced between the static eliminating member 358 and the second roller 354. Here, the width of the gap is suitably determined in consideration of static elimination performance of the grounded first roller 353 and others. Thereby, an electric charge amount accumulated in the conveying belt 351 is adjusted in a suitable value.

In the image forming apparatus 10 according to the second embodiment, experimentation searching scattering condition of the toner at the separation position 351C and occurrence condition of the image failure was carried out while varying structure of the transferring device 35 as Example 3 and Example 4. Experiment results are shown in FIG. 9. Incidentally, a searching way of the scattering condition of the toner and a searching way of the occurrence condition of the image failure in this experimentation are similar to the experimentation of the image forming apparatus 10 according to the first embodiment.

In accordance with the experiment results shown in FIG. 9, in a case where the voltage is applied to the guide member 355 (in Example 3 and Example 4), as compared with a case where the voltage is not applied to the guide member 355, the occurrence of the image failure is restrained. This seems to be brought as a result of injecting the electric charge with the negative polarity to the sheet by the electric discharge produced between the guide member 355 and the sheet and improving the electrostatic adhesion of the toner with respect to the sheet.

Moreover, in accordance with the experiment results shown in FIG. 9, in a case where the second roller 354 is in the insulation state (in Example 3, Example 4 and Comparative example 4), as compared with a case where the second roller 354 is grounded (in Comparative example 3), the scattering of the toner at the separation position 351C is restrained. This seems to be brought as a result of restraining the occurrence of the separation electric discharge between the sheet and the conveying belt 351 at the separation position 351C.

While the present disclosure has been described with reference to the preferable embodiment of the image forming apparatus of the disclosure and the description has technical preferable illustration, the disclosure is not to be restricted by the embodiment and illustration. Components in the embodiment of the present disclosure may be suitably changed or modified, or variously combined with other components. The claims are not restricted by the description of the embodiment.

What is claimed is:

1. A transferring device comprising:

a conveying belt arranged so as to face to an image carrier carrying a toner image and to contact the image carrier and convey a sheet via a contact position therebetween;

a transferring roller, to which a voltage with a reversed polarity to a charged polarity of the toner forming the toner image is applied, transferring the toner image carried on the image carrier onto the sheet at the contact position;

a stretching roller stretching the conveying belt at a downstream side from the contact position in a conveying direction of the conveying belt and at a separation position, where the sheet is separated from the conveying belt; and a guide member, to which the voltage with the reversed polarity to the charged polarity of the toner is applied, arranged at a position facing to the sheet conveyed from the stretching roller to a fixing device fixing the toner image onto the sheet.

2. The transferring device according to claim 1, wherein the stretching roller is in an insulation state.

3. The transferring device according to claim 2 further comprising:

a fourth voltage applying part applying the voltage with the reversed polarity to the charged polarity of the toner to the transferring roller and the guide member.

4. The transferring device according to claim 3 further comprising:

a second resistor arranged on an electric conductive path between the fourth voltage applying part and the guide member and has a resistance value higher than an electric conductive path including the transferring roller, the conveying belt and the image carrier.

5. The transferring device according to claim 3, wherein the fourth voltage applying part applies the voltage with the reversed polarity to the charged polarity of the toner until a trailing end part of the sheet in the conveying direction is separated from the guide member after a leading end part of the sheet in the conveying direction arrives at the contact position.

6. The transferring device according to claim 2 further comprising:

a fifth voltage applying part applying the voltage with the reversed polarity to the charged polarity of the toner to the transferring roller; and a sixth voltage applying part applying the voltage with the reversed polarity to the charged polarity of the toner to the guide member.

7. The transferring device according to claim 1, wherein the guide member is arranged at a position facing to a face of the sheet at a side of the stretching roller.

8. An image forming apparatus comprising:

the transferring device according to claim 1.

9. A transferring device comprising:

a conveying belt arranged so as to face to an image carrier carrying a toner image and to contact the image carrier and convey a sheet via a contact position therebetween;

a transferring roller, to which a voltage with a reversed polarity to a charged polarity of the toner forming the toner image is applied, transferring the toner image carried on the image carrier onto the sheet at the contact position;

a stretching roller stretching the conveying belt at a downstream side from the contact position in a conveying direction of the conveying belt and at a separation position, where the sheet is separated from the conveying belt; and a guide member, to which the voltage with the reversed polarity to the charged polarity of the toner is applied, arranged at a position facing to the sheet conveyed from the stretching roller to a fixing device fixing the toner image onto the sheet, wherein the stretching roller is configured to which the voltage with the reversed polarity to the charged polarity of the toner is applied.

10. The transferring device according to claim 9 further comprising:

a first voltage applying part applying the voltage with the reversed polarity to the charged polarity of the toner to the transferring roller, the stretching roller and the guide member.

11. The transferring device according to claim 10 further comprising:

a first resistor, wherein the stretching roller and the guide member are connected to the first voltage applying part via a common electric conductive path, the first resistor is arranged on the common electric conductive path and has a resistance value higher than an electric conductive path including the transferring roller, the conveying belt and the image carrier.

12. The transferring device according to claim 10, wherein the first voltage applying part applies the voltage with the reversed polarity to the charged polarity of the toner until a trailing end part of the sheet in the conveying direction is separated from the guide member after a leading end part of the sheet in the conveying direction arrives at the contact position.

13. The transferring device according to claim 9 further comprising:

a second voltage applying part applying the voltage with the reversed polarity to the charged polarity of the toner to the transferring roller; and a third voltage applying part applying the voltage with the reversed polarity to the charged polarity of the toner to the stretching roller and the guide member.

14. The transferring device according to claim 9, wherein the guide member is arranged at a position facing to a face of the sheet at a side of the stretching roller.

15. An image forming apparatus comprising:

the transferring device according to claim 9.

* * * * *